US005834067A

United States Patent [19]

Rodely

[11] Patent Number: 5,834,067

[45] **Date of Patent: *Nov. 10, 1998**

[54] POWDER PAINT STENCILING ON A POWDER PAINT SUBSTRATE

[75] Inventor: Brian Rodely, DuQuoin, Ill.

[73] Assignee: Maytag Corporation, Newton, Iowa

[ * ] Notice: This patent issued on a continued prosecution application filed under 37 CFR 1.53(d), and is subject to the twenty year patent term provisions of 35 U.S.C. 154(a)(2).

[21] Appl. No.: 789,866

[22] Filed: Jan. 28, 1997

[51] Int. Cl.[6] ..... B05D 1/06; B05D 1/36; B05D 1/38; B05D 3/02

[52] U.S. Cl. ..... 427/469; 427/470; 427/475; 427/485; 427/486; 427/203; 427/204

[58] Field of Search ..... 427/461, 469, 427/470, 485, 486, 475, 202, 382.5, 203, 282, 180, 195, 473, 474; 101/129

[56] References Cited

U.S. PATENT DOCUMENTS

| | | | |
|---|---|---|---|
| 3,377,183 | 4/1968 | Hurt, Jr. et al. | 427/486 |
| 3,445,310 | 5/1969 | Danielson et al. | 156/230 |
| 3,811,910 | 5/1974 | Labana et al. . | |
| 3,928,655 | 12/1975 | Iwasa et al. . | |
| 4,254,163 | 3/1981 | Piazza . | |
| 4,294,009 | 10/1981 | Quintin et al. . | |
| 4,393,112 | 7/1983 | Honjo et al. | 428/207 |
| 4,410,562 | 10/1983 | Nemoto et al. . | |
| 5,355,794 | 10/1994 | Freudenheim | 101/129 |

FOREIGN PATENT DOCUMENTS

| | | |
|---|---|---|
| 1046614 | 10/1966 | United Kingdom . |
| 2 189 408 | 10/1987 | United Kingdom . |
| 2189408 | 10/1987 | United Kingdom . |

*Primary Examiner*—Shrive Beck
*Assistant Examiner*—Fred J. Parker
*Attorney, Agent, or Firm*—Zarley, McKee, Thomte, Voorhees & Sease

[57] ABSTRACT

A method of marking appliances is described. The method comprises coating an appliance or other substrate capable of producing an electrostatic charge with a first powder paint layer. This first layer is then either cured or a second powder paint layer is applied immediately thereafter in the desired design or lettering. The layered substrate is then allowed to cure. The invention presents the advantages of eliminating the need of a volatile ink and the capability of being performed in one step.

12 Claims, 1 Drawing Sheet

POWDER PAINT STENCILING ON A POWDER PAINT SUBSTRATE

BACKGROUND OF THE INVENTION

Appliance manufacturers typically place instructions on their appliances, for example, on the underside of an automatic washer lid. Traditional methods of placing instructions on appliances have included the use of an ink to stencil the information on the appliance. There are, however, several problems involved with using ink. Inks typically contain volatile organic compounds which are released into the air during the curing procedure. These compounds are harmful to the environment and also present a danger to persons working with the ink who may inhale the toxic substances emitted from the ink. Further, governmental regulations are discouraging the use of such environmentally hazardous inks.

Powder paints have traditionally been used for coating appliances. Typically, the powder paint is placed on the substrate and the instructions are then printed on the powder paint using the aforementioned volatile inks. This process involves two separate steps wherein the powder paint is first applied to the appliance and allowed to cure. The ink is then applied on top of the powder paint and allowed to cure. It has now been discovered that powder paints can be used for printing instructions on appliances or other substrates without the use of volatile inks, thereby removing their toxic effects and eliminating the number of steps necessary to perform the marking process.

It is therefore a primary object of the present invention to provide a method for marking a substrate which does not use a volatile ink.

It is another object of the present invention to provide a method for marking a substrate, such as an appliance lid, which is safe for the environment and also for human use.

It is yet another object of the present invention to provide a method for placing lettering or designs on a substrate which is economical and simple to use.

The method of accomplishing these and other objects will become apparent from the following description of the invention.

SUMMARY OF THE INVENTION

This invention relates to a novel method for marking an appliance lid or other substrate using powder paint. The method involves either a one-step or two-step curing process. In the one-step process, the substrate is coated with powder paint, stenciled or silk screened with a different color powder paint and the substrate is then cured. In the two-step process, the substrate is first coated with powder paint and then at least partially cured to fix the powder paint. The coated substrate is then stenciled with a different color powder paint and the substrate is fully cured.

The current method offers several advantages over prior art methods. First, the method can be performed in only one step, thus decreasing manufacturing costs and increasing productivity. Further, by eliminating the need for volatile inks, the current method is safer for the environment and safer for persons who would otherwise be inhaling toxic fumes emitted from the volatile ink during the curing process.

DETAILED DESCRIPTION OF THE PREFERRED EMBODIMENT

Figure 1:
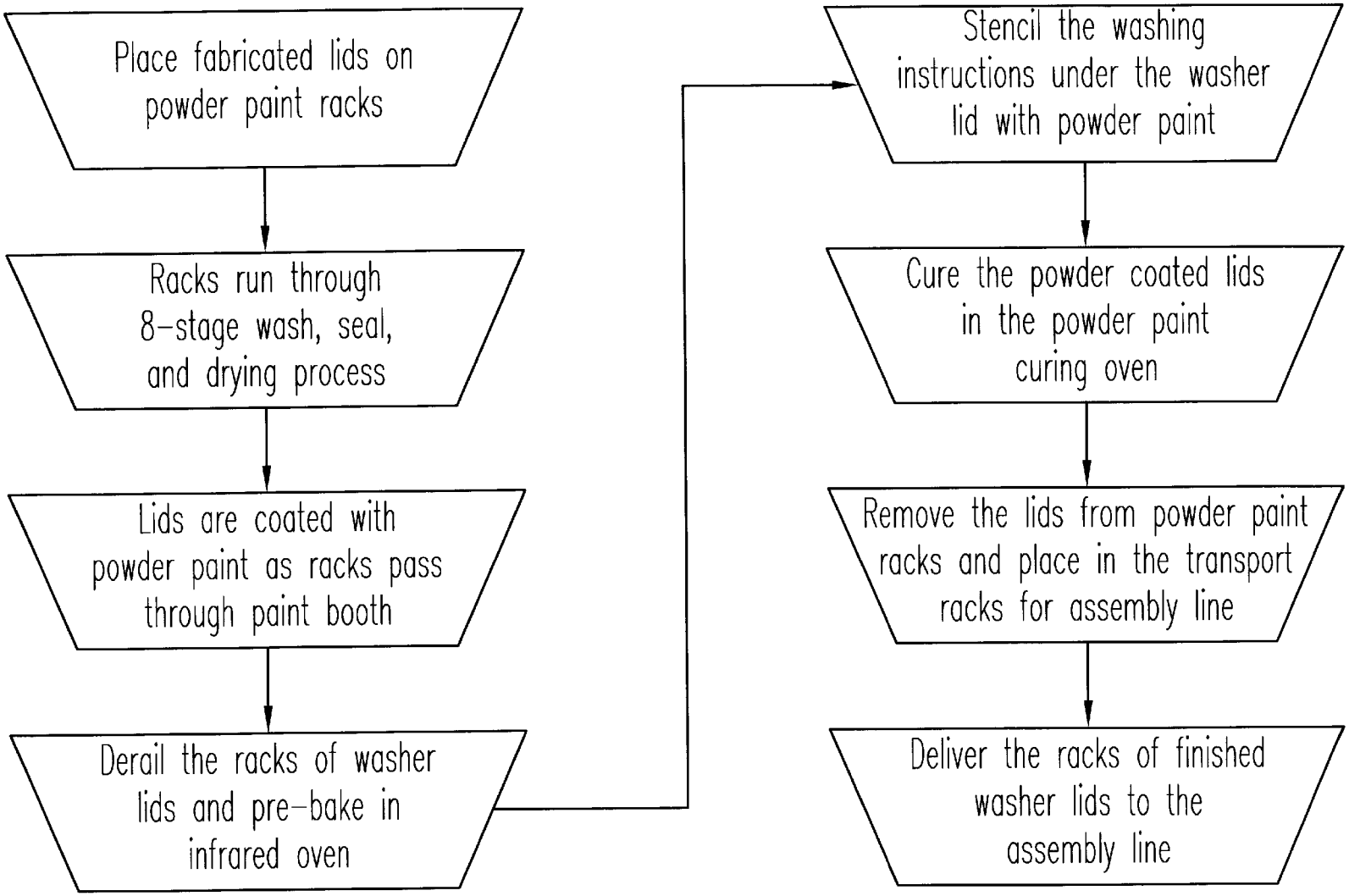
FIG. 1 is a flow chart showing a preferred two-step process of the present invention using an automatic washer lid.

The present invention discloses a method for marking a substrate, such as a surface of an appliance lid, without the need for a volatile ink. The method uses powder paints which can be applied using either a one-step or a two-step curing process.

Powder paints are generally known in the art. The term "powder paint" is used herein to describe a substance which is distinguished from an unfixable powder. The powder paint must be capable of retaining an electrostatic charge for a predetermined period and have the ability to fuse at a predetermined temperature to form a continuous film. In general, powder paints comprise pigments such as chrome yellow, ultramarine, red iron oxide, calcium carbonate, carbon black, vinyl monomer graft carbon black, titanium dioxide, etc., dispersed in a resinous material and have a particle size ranging from about 3 microns to 5 mm, preferably in the range of from about 20–150 microns. Epoxy resins, polyamides, polyesters, polyvinyl chlorides, cellulose acetate butylates, acryl resins and methacryl resins may also be included.

Also, resinous materials which can be hardened upon reaction with polyhydric alcohols, alkylene isocyanates, or arylene isocyanates or can be hardened upon irradiation of electromagnetic waves or corpuscular beams are used as resinous materials for powder paints. In this case, resinous materials having reactive groups such as epoxy rings, hydroxyl groups, $\alpha,\beta$-unsaturated acryloxy groups (e.g., acryloxy groups, methacryloxy groups, cinnamoyloxy groups, etc.), allyl groups, cinnamyl groups, quinone azide groups and sulfonyl azide groups can be used. Further, solvent and scratch resistance can be improved by applying post treatment. In the present invention, polyester based powder paints are preferred with Ferro™ brand polyester powder paint being most preferred. The powder paints may also include flow agents, fillers, or other conventional additives.

In the two-step process, the substrate is first coated with a powder paint and then at least partially cured to fix the powder paint to the substrate. Next, another powder paint is applied using conventional methods. As a practical matter, it will be desirable to apply a powder paint with a contrasting color from the color used to coat the substrate in order to provide effective marking. While the one-step curing process also produces a workable product, the two-step process is preferred. By allowing the first layer to first partially cure, the powder paint is thermally fixed to the substrate before applying the second layer. It is therefore less likely that the second layer will disturb the first layer.

Any substrate can be used for the present invention provided that it has a suitable electroconductive surface. A preferred conductivity is not less than $10^{-10}$(ohm square)$^{-1}$. After the first coating layer of powder paint is applied, there is still a sufficient amount of electroconductivity present so that the second layer can electrostatically bond to the first layer. The powder paint layers are typically applied to the substrate to achieve a thickness of approximately 3.5 mils. A suitable coating thickness for the first powder paint layer is from about 0.003 inches to 0.004 with 0.0035 being preferred. A suitable coating thickness for the second powder paint layer is from about 0.003 to 0.004 with 0.0035 being preferred.

The powder paint can be applied to a wide range of conductive substrates, especially metallic articles, such as can bodies, wire goods, pipe, tool housings, fire extinguisher bodies, household appliances, floor polishing machinery, sewing machine parts, hospital beds, trailer hitches, parts and accessories for automobiles, motorcycles, and bicycles, furniture for lawn, garden office and home, and structural sections and facade elements. Other substrates would include metallic plates such as iron or aluminum, paper or paint coated steel plates treated with electrically conductive materials such as alumina, calcium carbonate, magnesia, etc., coated using a resin such as styrene-maleic acid anhydride, polyvinyl alcohol, etc. The preferred substrate is precoated steel plates, i.e. steel plates which are coated with paint, such as is commonly found on household appliances.

During the powder paint coating process, the paint can be applied to the substrate using an art-known method, such as by sprinkling, coating, pressing, transferring, or spraying. For example, the powder coating composition may be attached on a heated substrate and fused to form a uniform continuous film, such as with spray coating or flow dipping coating. The substrate may also be heated upon coating such that it is coated in a molten condition through means such as flame spraying or plasma spraying. Also, an electric charge may be given to the powder paint which is attached on the substrate by electrostatic powder which is then baked and dried. Generally, the powder is projected toward the substrate so that the aerodynamic forces bring the powder particles as close as possible to the substrate, where electrostatic forces predominate and cause the particles to be attracted to and deposited on the grounded substrate. The preferred application method is by use of a fluidized bed wherein the powder paint particles are suspended. Air pressure applies an electrostatic charge to the powder paint and drives it through an application apparatus, such as a gun.

During the application procedure, the powder paint requires no drying time and the substrate can therefore be cured immediately following the powder paint coating.

Similarly, if the one-step process is used, the second powder paint layer can be applied immediately after the first. The powder paint is applied at ambient temperatures of from about 60°–90° F. (15°–32° C.) and preferably at a humidity level in the range of from about 40–60%, with about a 50% humidity level being most preferred.

The coated substrate is placed in an oven or furnace where the individual powder particles melt, flow and form a continuous film on the substrate. The powder particles fuse at a temperature of from about 90° C. to about 250° C. depending on the resin type and the nonmeltable ingredients which may be intermixed with the melted material. A curing period of time is inversely proportional to the curing temperature, but generally is from about 1–5 minutes at 200°–250° C. or 10–30 minutes at 160°–200° C. The preferred curing temperature and time is about 200° C. for about 12 minutes.

The application of the second powder paint layer can be performed using conventional methods, including but not limited to stenciling or silk screening. In the stenciling procedure, a mesh screen can be utilized to direct the powder paint only to pre-selected areas of the substrate. Again, the powder paint can be sprayed on or applied using any of the methods previously described. The stenciling or silk screening should be done with a contrasting color of powder paint from that used for the initial coating so that the lettering/design can be seen. After the stenciling is completed, the coated substrate is cured using the same times and temperatures described above such that it bonds to the coated substrate.

When performing the one-step version of the present process, the curing step performed in between powder paint layers is eliminated. Instead, the second powder paint is stenciled or silk screened directly onto the powder paint used to coat the substrate and then cured for a time and temperature sufficient to fuse the powder paint to the substrate. By eliminating the curing step performed in between layers, the present process can be performed faster and less expensively than conventional marking processes.

The process of the present invention is preferentially used in conjunction with marking appliances. Manufacturers of appliances typically place instructions directly on appliances, such as on the inside of a washer lid. FIG. 1 describes in detail a preferred two-step process of the present invention as used in marking washer lids.

As shown above, the process of the present invention offers the distinct advantage of being performed without the need of a volatile ink. It is therefore not toxic to the person performing the process and is safer for the environment. Further, it may also be performed using only one step, thus saving time and money in comparison to previously known methods. It can therefore be seen that the present invention accomplishes at least all of its stated objectives.

What is claimed is:

1. A method of applying markings in the form of letterings or designs on an electroconductive substrate comprising:

coating the electroconductive substrate with a first powder paint to form a coated substrate at ambient temperatures of between about 15°–32° C., wherein the first powder adheres to the electroconductive substrate through electrostatic attraction;

applying markings of a second powder paint to the uncured first powder paint coating adhered to the electroconductive substrate to form a marked substrate: and curing the marked substrate.

2. A method according to claim 1 wherein the marked substrate is cured by heating the marked substrate to a temperature of between about 90°–250° C.

3. A method according to claim 2 wherein the marked substrate is cured by heating the marked substrate to a temperature of about 200° C. for about 12 minutes.

4. A method according to claim 1 wherein the curing step is performed in an oven.

5. A method according to claim 1 further comprising the step of:

curing partially the coated substrate prior to applying the second powder paint.

6. A method according to claim 1 wherein the second powder paint is applied to the first powder paint coating by a method selected from the group consisting of stenciling and silk screening.

7. In a method of applying markings in the form of lettering or designs on an electroconductive appliance lid, where the lid is coated with a layer of powder paint which is electrostatically attracted to the lid and at least partially cured to fix the powder paint to the lid, wherein the powder paint is applied at ambient temperatures of between about 15°–32° C., the improvement comprising:

applying markings of a second powder paint to the first powder paint coating adhered to the lid to form a marked substrate, wherein the application is performed without the use of a volatile ink.

8. A method according to claim 7 wherein the second layer of powder paint is applied before the coated lid is cured.

9. A method according to claim 7 wherein the second layer of powder paint is applied after the coated lid is cured.

10. A method of applying markings in the form of lettering or designs on an electroconductive substrate comprising:

coating the electroconductive substrate with a first powder paint to form a coated substrate, said first powder paint having an electric charge sufficient to adhere the first powder paint to the substrate, and further providing that the coating step takes place at ambient temperatures of from about 15°–32° C.;

applying markings of a second powder paint to the first powder paint coating adhered to the electroconductive substrate to form a marked substrate;

curing the marked substrate.

11. A method of marking an electroconductive substrate comprising:

coating the electroconductive substrate with a first powder paint to form a coated substrate without the use of a volatile ink, wherein the first powder paint is electrostatically attracted to the electroconductive substrate, and further providing that the coating takes place at a temperature of about 60°–90° F.;

curing partially the coated substrate;

marking the first powder paint with a second powder paint to form a marked substrate;

curing the marked substrate.

12. A method of applying markings in the form of lettering or designs on an electroconductive substrate comprising:

coating the electroconductive substrate with a first powder paint to form a coated substrate without the use of a volatile ink, wherein the first powder paint is electrostatically attracted to the electroconductive substrate, and further providing that the coating takes place at a temperature of about 15°–32° C.;

curing partially the coated substrate to fix the first powder paint to the substrate;

applying markings of a second powder paint to the first powder paint coating adhered to the electroconductive substrate to form a marked substrate; and curing the marked substrate.

* * * * *

UNITED STATES PATENT AND TRADEMARK OFFICE

CERTIFICATE OF CORRECTION

PATENT NO. : 5,834,067
DATED : November 10, 1998
INVENTOR(S) : Brian Rodely

It is certified that error appears in the above-identified patent and that said Letters Patent is hereby corrected as shown below:

Columns 5 and 6,
Lines 14 through 4, claim 11, as written should be removed

Column 6,
Lines 5 through 20, "claim 12" should become -- claim 11 --

Signed and Sealed this

Eleventh Day of June, 2002

*Attest:*

*Attesting Officer*

JAMES E. ROGAN
*Director of the United States Patent and Trademark Office*